US008843032B2

(12) United States Patent
Kubo

(10) Patent No.: US 8,843,032 B2
(45) Date of Patent: Sep. 23, 2014

(54) IMAGE FORMING APPARATUS WITH ELECTRICAL DISCHARGE SUPPRESSION

(75) Inventor: Norihiko Kubo, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 191 days.

(21) Appl. No.: 13/363,663

(22) Filed: Feb. 1, 2012

(65) Prior Publication Data

US 2012/0201561 A1 Aug. 9, 2012

(30) Foreign Application Priority Data

Feb. 3, 2011 (JP) ..... 2011-021579

(51) Int. Cl.
*G03G 15/02* (2006.01)
*G03G 21/00* (2006.01)

(52) U.S. Cl.
USPC ..... 399/128; 399/50

(58) Field of Classification Search
USPC ..... 399/127, 128, 50, 61, 258
IPC ..... G03G 21/06,21/08, 21/0094, 15/0266
See application file for complete search history.

(56) References Cited

U.S. PATENT DOCUMENTS 4,621,920 A * 11/1986 Takahashi ..... 399/128
5,130,749 A * 7/1992 Tanada ..... 399/76
5,794,097 A * 8/1998 Shinkawa et al. ..... 399/43
5,911,097 A * 6/1999 Haga et al. ..... 399/174
6,704,522 B2 * 3/2004 Sasago et al. ..... 399/12
6,970,661 B2 * 11/2005 Shoji ..... 399/50
2008/0113285 A1 * 5/2008 Nakamori et al. ..... 430/48

FOREIGN PATENT DOCUMENTS

JP 01024288 A * 1/1989
JP 1-113780 A 5/1989
JP 04060681 A * 2/1992
JP 11038740 A * 2/1999
JP 2000147967 A * 5/2000
JP 2007034086 A * 2/2007

* cited by examiner

*Primary Examiner* — Robert Beatty
(74) *Attorney, Agent, or Firm* — Fitzpatrick, Cella, Harper & Scinto

(57) ABSTRACT

An image forming apparatus includes a photosensitive member, a charging device for electrically charging the photosensitive member, an electrostatic image forming portion for forming an electrostatic image on the photosensitive member, and a developing device including a toner carrying member and a screw. In addition, a charging power source applies a charge potential to the charging device, a developing power source applies a developing potential to the developing device, a transfer device transfers a toner image formed on the photosensitive member, and an exposure device electrically discharges a surface of the photosensitive member by exposing it to light. A controller controls the exposure device so that an exposure operation is in an off state in the period in which a toner feeding operation is performed or so that an exposure amount of the exposure device in the period in which the toner feeding operation is performed is smaller than an exposure amount of the exposure device in a period in which the toner image is formed on the surface of the photosensitive member.

2 Claims, 14 Drawing Sheets

IMAGE FORMING APPARATUS WITH ELECTRICAL DISCHARGE SUPPRESSION

FIELD OF THE INVENTION AND RELATED ART

The present invention relates to an image forming apparatus, having a function of forming an image on a recording material of, e.g., a sheet or the like, such as a copying machine, a printer or a facsimile machine.

The image forming apparatus of an electrophotographic type in which a charging member is contacted to a photosensitive member to uniformly charge the photosensitive member and then an electrostatic image is formed on the charged photosensitive member by exposure has been conventionally known.

In a general image forming process in the electrophotographic type, the electrostatic image formed on the photosensitive drum is developed with a toner into a toner image and the thus-obtained toner image is transferred onto the recording material and is fixed on the recording material by heat and pressure, so that a print is outputted.

Here, when a voltage is applied to the charging member, electric discharge is generated at both sides of a portion where a contact member is contacted to an object to be discharged, such as the photosensitive member or an intermediary transfer member. When the electric discharge is generated in the air, an electric discharge product such as a nitrogen oxide is generated from the air, so that the generated electric discharge product is deposited on the photosensitive member.

Recently, in order to extend a lifetime, the photosensitive member having a surface layer with high hardness is used. The surface of the photosensitive member with high hardness is not readily abraded and therefore the electric discharge product has been unable to be sufficiently removed by a cleaning member such as a cleaning blade.

The electric discharge product which has not been sufficiently removed by the cleaning member causes, when it absorbs moisture in the air, image defect which is called image flow. For that reason, in the case where the high-hardness photosensitive member is used, it would be considered that the electric discharge product is removed by incorporating organic fine particles as abrasives into a developer (Japanese Laid-Open Patent Application Hei 1-113780).

By employing the above constitution, even in the case where the photosensitive member has the high hardness, the photosensitive member is sufficiently abraded by the abrasives incorporated in the developer, so that an effect such that the occurrence of the image flow is suppressed can be obtained.

However, even when abrasive particles for improving an abrasive force for the photosensitive member are contained in the developer, in the case where the abrasive particles are not supplied to the photosensitive member (e.g., in a period in which the developer is filled in an empty developing device), the present inventor noticed that the image flow cannot be sufficiently suppressed.

A conventional process cartridge or the like including the developing device or integrally including the developing device and the photosensitive member is shipped in a state in which at least a developing sleeve is not coated with the developer in order to prevent the developer (toner) from leaking out during conveyance. Specifically, the inside of a developing container is empty or the developing container is sealed with a film so as to prevent the toner contained in therein from leaking out. Thus, in the case where the developing device is provided in an apparatus main assembly in the state in which the developing sleeve is not coated with the developer, a series of operations for feeding the toner to the developing container, coating the developing sleeve with the toner and initializing various sensors on the basis of a proportion between the toner and a carrier of the developer in an initial state (these operations are referred to as a development initializing operation) is performed.

In such a period of the development initializing operation, the abrasives cannot be supplied to the photosensitive member sufficiently and therefore it is difficult to sufficiently remove the electric discharge product deposited on the photosensitive member.

SUMMARY OF THE INVENTION

According to an aspect of the present invention, there is provided an image forming apparatus comprising: a photosensitive member; a charging device for electrically charging the photosensitive member; a developing device for developing an electrostatic image formed on the photosensitive member, wherein the developing device includes a carrying member for carrying and conveying the toner to a position where the toner opposes the photosensitive member, and includes a screw, which is rotated by receiving a driving force from a driving source common to the screw and the carrying member, for feeding the toner; a transfer device for transferring a toner image formed on the photosensitive member; an exposure device, provided downstream of the transfer device and upstream of the charging device with respect to a rotational direction of the photosensitive member, for lowering a potential of the photosensitive member by exposing the photosensitive member to light; and a controller for effecting, in a period in which the screw is rotated to supply the toner to a portion of the carrying member where the toner is not carried, such a control that the toner is not moved from the carrying member to the photosensitive member by electrically charging the photosensitive member by the charging device and that an exposure amount of the photosensitive member by the exposure device is smaller than that during image formation.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the image forming apparatus according to the present invention will be described with reference to the drawings.

Embodiment 1

Figure 1:
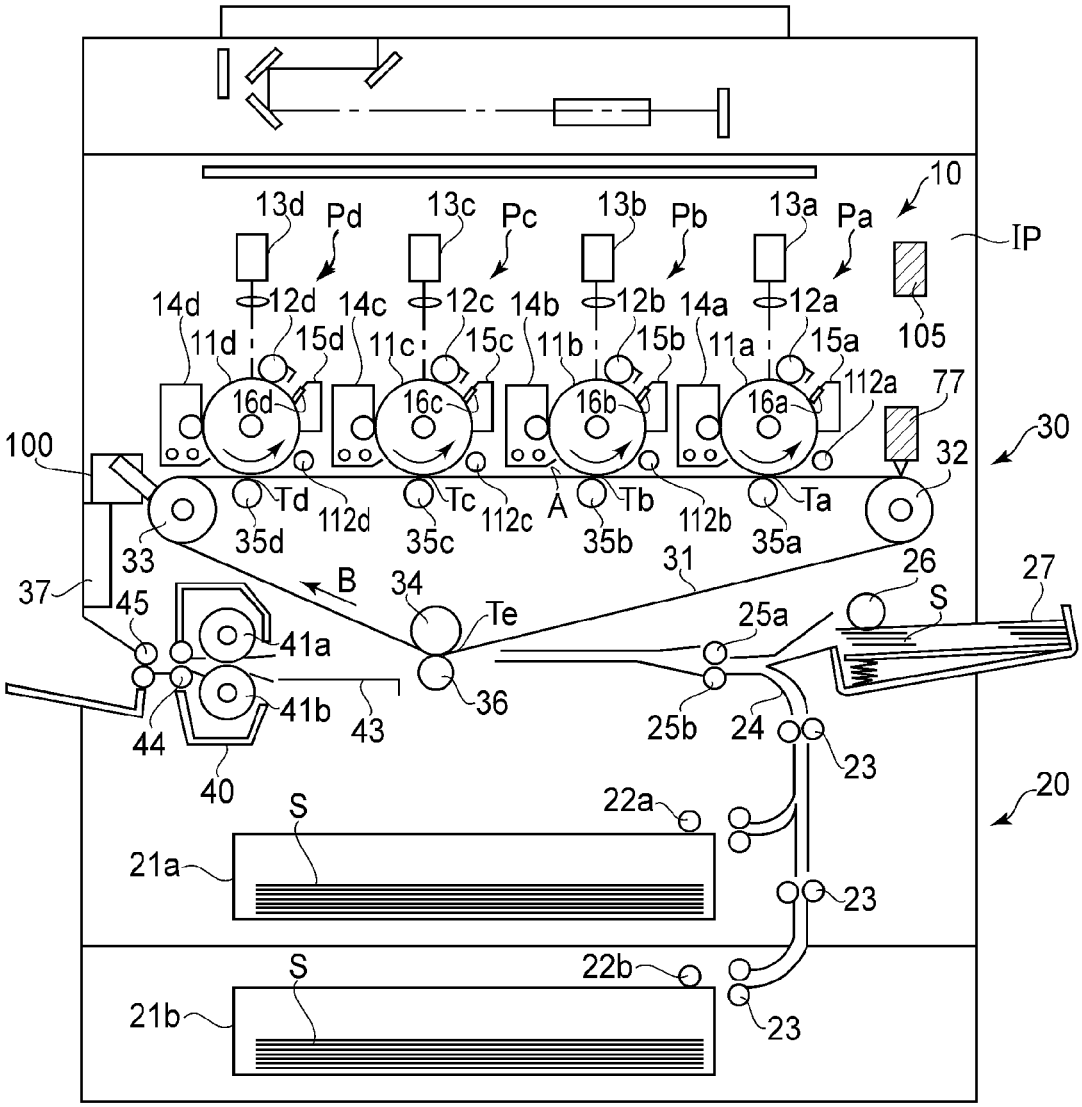
FIG. 1 is a schematic illustration of a color electrophotographic copying apparatus of a four-drum type which is an embodiment of an image forming apparatus according to the present invention.

FIG. 1 is a schematic cross-sectional view of an image forming apparatus in this embodiment according to the present invention. The image forming apparatus in this embodiment is a tandem-type four-color-based full-color image forming apparatus in which four image forming units are disposed side by side along a movement direction of an endless belt-type intermediary transfer member (intermediary transfer belt) which is a toner supporting member (transfer-receiving member).

The image forming apparatus includes an image output portion 1P. The image output portion 1P roughly includes an image forming portion 10 (10*a*, 10*b*, 10*c*, 10*d*), a sheet feeding unit 20, an intermediary transfer unit 30, a fixing unit 40, and a control unit 37. The image forming portion 10 includes four stations P (Pa, Pb, Pc and Pd) which are disposed side by side and have the same constitution.

Each of the units of the image forming apparatus will be described more specifically. At each station P, a drum-like electrophotographic photosensitive member (photosensitive drum) 11 (11*a*, 11*b*, 11*c*, 11*d*) as an image bearing member is shaft-supported at its center and is rotationally driven in a direction indicated by an arrow. Oppositely to an outer peripheral surface of the photosensitive member 11 (11*a*, 11*b*, 11*c*, 11*d*), along the rotational direction of the photosensitive member, a primary charger 12 (12*a*, 12*b*, 12*c*, 12*d*), a laser scanner unit 13 (13*a*, 13*b*, 13*c*, 13*d*) and a developing device 14 (14*a*, 14*b*, 14*c*, 14*d*) are disposed. In this embodiment, as the developing device 14 which is a developing means, the developing device 14*a* is representatively shown in FIG. 2 in which the discharge product 14*a* includes a developing sleeve 14*a*1 for carrying and conveying the developer and developing screws 14*a*2 for stirring the developer. Other developing devices 14*b* to 14*d* have the same constitution.

In this embodiment, as the developer, a two-component developer containing a non-magnetic toner and a magnetic carrier is used. Further, as a characteristic of a color toner (non-magnetic toner particles), it is preferable that a weight-average particle size is 5-8 μm for forming a good image. When the weight-average particle size is within this range, a sufficient resolution property is provided, so that a clear and high-quality image can be formed and a deposition force and an agglomeration force become smaller than an electrostatic force, thus reducing a degree of various troubles.

In this embodiment, primary transfer rollers 12*a*-12*d* as a primary charging member constituting the primary charger which is a charging means provide electric charges having uniform charge amount to the surface of the photosensitive drums 11*a*-11*d*. Then, by the laser scanner units 13*a*-13*d* which are an information writing means, the photosensitive members 11*a*-11*d* are exposed to a light beam such as a laser beam modulated correspondingly to a recording image signal, so that an electrostatic latent image is formed on each of the photosensitive drums 11*a*-11*d*.

Further, the developers (toners) of four colors of yellow, cyan, magenta and black are supplied to the electrostatic latent images by the developing devices 14*a*-14*d* containing the developers, respectively, so that the electrostatic latent images are visualized. The resultant developer images, i.e., the toner images are transferred onto an intermediary transfer belt 31, which is a transfer-receiving material, in image transfer areas Ta, Tb, Tc and Td. Downstream of the image transfer areas Ta, Tb, Tc and Td, toners remaining on the photosensitive drums 11*a*-11*d* without being transferred onto a recording material S are scraped off by cleaning devices 15*a*, 15*b*, 15*c* and 15*d*, so that the respective drum surfaces are cleaned.

By the above-described process, image forming operations with the respective toners are successively performed.

As each of the photosensitive drums 11*a*-11*d*, a negatively chargeable OPC photosensitive drum was used. Specifically, as a photosensitive member layer, a negatively chargeable organic semiconductor layer (OPC layer) obtained by laminating a 29 μm-thick CTL layer (carrier transporting layer), in which hydrazone resin is mixed, on a CGL layer (carrier generating layer) of an azo pigment is used.

Next, the cleaning device 15 (15*a*, 15*b*, 15*c*, 15*d*) as a cleaning means will be described.

As the cleaning device 15 (15*a*-15*d*), a counter blade type cleaning device is used and a free length of a cleaning blade 16 (16*a*-16*d*) is 8 mm. The cleaning blade 16 is an elastic blade principally comprising urethane resin and is contacted to the photosensitive drum 11 with a linear pressure of about 35 g/cm.

In this embodiment, the above-described photosensitive drum 11, primary charger 12, developing device 14 and cleaning device 15 are integrally assembled into a unit to constitute a process cartridge, which is detachably mountable to an image forming apparatus main assembly. However, the present invention is not limited to this constitution.

The sheet-feeding unit 20 includes cassettes 21*a* and 21*b* for accommodating the recording material S, a manual feeding tray 27, and pick-up rollers 22*a*, 22*b* and 26 for feeding the recording material S one by one from the cassettes 21*a* and 21*b* and the manual feeding tray 27. Further, the unit 20 includes sheet-feeding roller pairs 23 and a sheet feeding guide 24 which are used for conveying the recording material S, fed from each of the pick-up rollers 22*a*, 22*b* and 26, to registration rollers 25*a* and 25*b*. The registration rollers 25*a* and 25*b* are rollers for sensing the recording material S to a secondary transfer area Te in synchronism with image formation timing of the image forming portion.

The intermediary transfer unit 30 will be described in detail.

As a material for the intermediary transfer belt 31, it is possible to use, e.g., PET (polyethylene terephthalate) and PVdF (polyvinylidene fluoride). The intermediary transfer belt 31 is stretched and extended around a driving roller 32 for transmitting a driving force of the intermediary transfer belt 31, a tension roller 33 for applying proper tension to the intermediary transfer belt 31 by urging of springs (not shown), and a follower roller 34 which opposes the secondary transfer area Te via the belt. The intermediary transfer belt 31 is circulated and moved in an arrow B direction in FIG. 1, i.e., in the clockwise direction, so that between the driving roller 32 and the tension roller 33, a primary transfer flat surface A is created. The driving roller 32 is constituted by coating the surface of a metal roller with a several mm-thick layer of a rubber (urethane rubber or chloroprene rubber), thus being prevented from slipping on the belt. The driving roller 32 is rotationally driven by a pulse motor (not shown).

In the primary transfer areas Ta-Td in which the photosensitive drums 11*a*-11*d* and the intermediary transfer belt 31 oppose each other, primary transfer rollers 35 (35*a*, 35*b*, 35*c*, 35*d*) are disposed on the back surface of the intermediary transfer belt 31. The secondary transfer roller 36 is disposed oppositely to the follower roller 34 to form the secondary transfer area Te in a nip belt itself and the intermediary transfer belt 31.

The secondary transfer roller 36 is urged against the intermediary transfer belt 31 under a proper pressure. Further, in the rotational direction of the intermediary transfer belt 31, downstream of the secondary transfer area Te, a brush roller (not shown) for cleaning an image forming surface of the intermediary transfer belt 31 and a residual toner box (not shown) for containing residual toner are provided. Further, on the intermediary transfer belt 31, a cleaning device 100 for removing secondary transfer residual toner is provided.

The fixing unit 40 includes a fixing roller 41*a* provided with a heat source such as a halogen heater inside the fixing roller 41*a* and includes a pressing roller 41*b* to be pressed by the fixing roller 41*a*. The pressuring roller 41*b* may also contain the heat source. The fixing unit 40 further includes a guide 43 for guiding the recording material S into a nip between the rollers 41*a* and 41*b*, and inner sheet discharging rollers 44 and outer sheet discharging rollers 45 for guiding the recording material S, discharged from the rollers 41*a* and 41*b*, to the outside of the image forming apparatus.

The control unit 37 is constituted by a control board for controlling operations of mechanisms in the above-described respective units and by a motor drive board (not shown) and the like and includes a control means (CPU) 301 (FIG. 11) or the like. Further, an environment sensor 15 is disposed at a position indicated in FIG. 1 so that an ambient temperature/humidity of the image forming apparatus can be accurately measured without being influenced by the fixing unit 40 which is a heat source in the image forming apparatus. On the basis of an output of the environment sensor 105, various control operations are effected.

As the intermediary transfer belt 31, a 100 μm-thick polyimide film is used, and in this embodiment the case where an urethane sponge roller is used as the primary transfer roller 35 (15*a*-35*d*) provided at the primary transfer portion will be described.

In the image forming apparatus used in this embodiment, a peripheral speed of the intermediary transfer belt 31 is 300 mm/sec and a width of each of the primary transfer portions with respect to the thrust direction is 330 mm. The toner on the photosensitive member 11 has a charge retaining amount of 30 μC/g and a current of 40 μA is applied to a core metal of the primary transfer roller 35 during the primary transfer. This applied current amount may desirably be changed depending on a change in toner charge retaining amount or the like caused due to a change in environment but the above value is a proper current value set in a normal environment (23° C./60% RH).

Next, the charging roller 12 which is the charging member will be described.

A roller surface layer of the charging roller 12 is formed of 1-2 mm thick electroconductive rubber in which an electroconductive material such as carbon black is dispersed and mixed, and is controlled so that a resistance value thereof is $10^5$ to $10^7$ ohm·cm in order to prevent charging non-uniformity during the image formation. Further, the charging roller 12 is of a contact type in which it is contactable to the photosensitive drum 11 without creating a gap by utilizing its elasticity, and charges the photosensitive drum 11 at a low voltage. Or, on a surface of an electroconductive support, ABS resin which contains an ion conductive polymeric compound such as polyetherester amide and is controlled so as to have a resistance value of $10^5$ to $10^7$ ohm·cm is coated in a thickness of 0.5 to 1 mm by injection molding to form a resistance adjustment layer. On the surface of the resistance adjustment layer, a protective layer of a thermoplastic resin composition containing electroconductive fine particles of tin oxide or the like dispersed therein is formed. As the electroconductive support to which a charging voltage is to be applied, a metal shaft member is used. The metal shaft member is constituted by integrally molding a shaft-supporting portion, a voltage-applying shaft-supporting portion, and a coating portion providing an outer diameter of 14 mm. On the peripheral surface of the coating layer, the resistance adjustment layer, of the ABS resin (thermoplastic resin) containing the ion conductive polymeric compound such as polyetherester amide, adjusted to have a volume resistivity of $10^5$ to $10^7$ ohm·cm is coated in the thickness of 0.5 to 1 mm by the injection molding.

Figure 2:
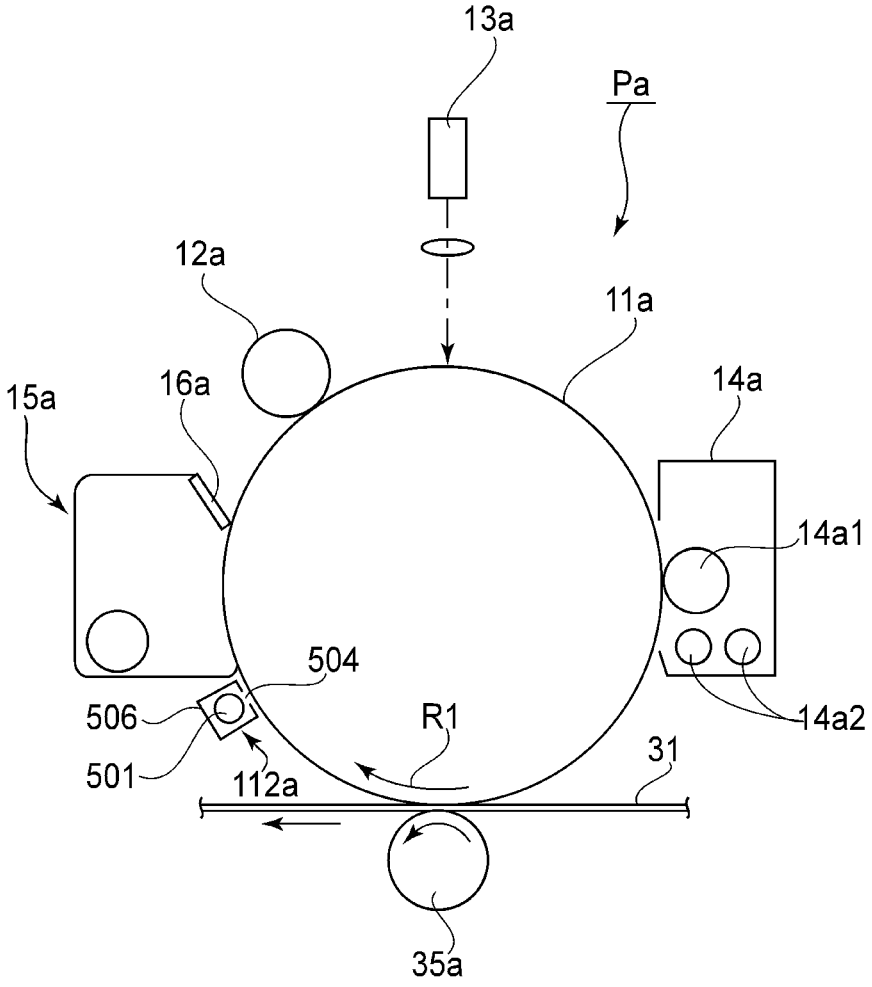
FIG. 2 is a schematic sectional view showing a constitution around a photosensitive drum of an image forming portion including a cleaning device provided with a cleaning pre-exposure means.

Next, the constitution, around the photosensitive drum 11, which constitutes the image forming portion 10 in this embodiment and the process cartridge will be described with reference to FIG. 2. In this embodiment, the four stations Pa, Pb, Pc and Pd constituting the image forming portion 10 have the same constitution and therefore in FIG. 2, the station Pa is representatively illustrated. Accordingly, the structure shown in FIG. 2 is also true for other stations Pb, Pc and Pd. In this embodiment, around the photosensitive drum 11*a*, the members including the charging roller 12*a*, the developing device 14*a*, the cleaning device 15*a* and the charge-removing device 112*a* are disposed.

Figure 7:
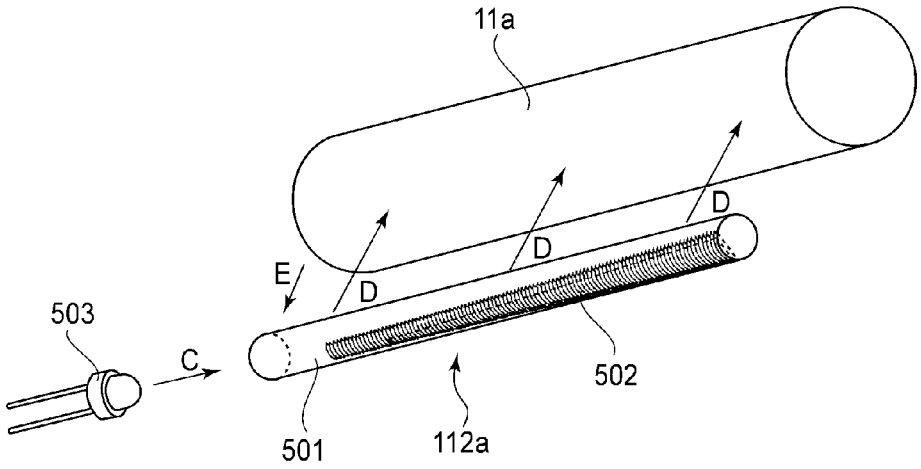
FIG. 7 is a schematic perspective view showing an embodiment of a pre-exposure means which is a charge-removing device.

FIG. 7 is a schematic view of the charge-removing device, i.e., an optical charge-removing means 112*a* shown in FIG. 2, for removing the electric charges by the exposure. Incidentally, in FIG. 7, portions other than the photosensitive drum 11*a* and the optical charge-removing means 112*a* are omitted. The optical charge-removing means 112*a* is, in this embodiment, disposed downstream of the transfer roller 35*a* and upstream of the charging roller 12*a* with respect to the rotational direction of the photosensitive drum 11*a*.

The optical charge-removing means 112*a* in the present invention is roughly constituted by the following two members.

1. Light-emitting source: "LED lamp" 503 provided to the image forming apparatus main assembly.

2. Light irradiating member: "Rod-like light guide" 501 provided in the process cartridge constituting each station P.

Here, the LED lamp 503 and the rod-like light guide 501 will be further described.

First, the light guide LED lamp 503 as the light-emitting source functions as a light source of the optical charge-removing means 112*a* and is provided outside an image forming apparatus side plate (image forming apparatus main assembly). Further, the LED lamp 503 is disposed outside a charge-removing width (area) on the photosensitive drum with respect to a longitudinal direction. That is, the LED lamp 503 exposes the light guide 501 to light from a direction C parallel (or non-parallel) to the longitudinal direction of the light guide 501 (or the photosensitive drum 11*a*). Further, a light-blocking measure (not shown) is also taken so that an end portion of the photosensitive drum 11*a* is unnecessarily exposed to the light from the LED lamp 503.

Next, the rod-like light guide 501 will be described with respect to a material, a shape, a function and an arrangement.

Figure 8:
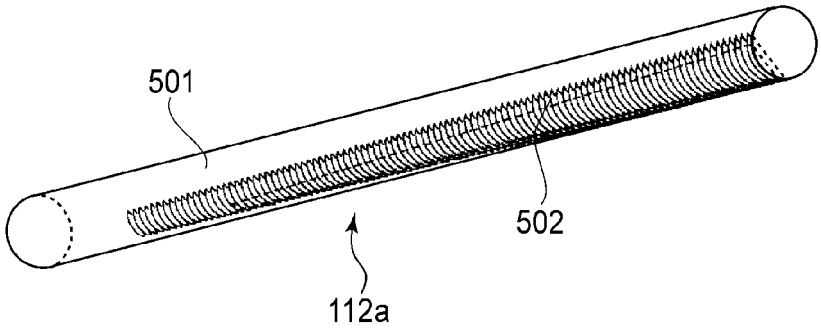
FIG. 8 is a schematic perspective view of a light guide used in the pre-exposure means.

As a material for the light guide 501, a resin material excellent in light transmittance, such as acrylic resin, polycarbonate or polystyrene, or glass is used. A shape of the light guide 501 is shown in FIG. 8 in an enlarged manner.

At a portion where the light guide surface opposes the photosensitive drum 11*a*, a plurality of V-shaped cuts 502 for forming projection/recess portion as a reflection means are provided. The number of the cuts 502 may be any number and can also be one. Further, the shape of the projection/recess portion is not necessarily V-shape but may also be other shapes such as U-shape and I-shape.

As shown in FIG. 7, by the V-shaped cuts 502, the light emitted from an end portion of the light guide 501 in an arrow C direction can be irradiated in a direction (arrow D direction) perpendicular to the light guide longitudinal direction. The surface of the photosensitive drum 11*a* is irradiated with the light, as "charge-removing light", with a predetermined charge-removing width (exposure width). Further, the depth of the V-shaped cuts 502 is larger and wider with a distance from the LED lamp 503 so that the surface of the photosensitive drum 11*a* is exposed to the charge-removing light with a uniform light quantity with respect to the longitudinal direction. That is, the size of the V-shaped cuts 502 is increased depending on a longitudinal position of the light guide 501, i.e., with an increasing distance from an exposure point (an incident point where the light from the LED lamp enters the light guide 501) of the LED lamp 503.

Further, in this embodiment, the light guide 501 is spaced from the photosensitive drum 11*a* with a spacing distance of 4 mm and is disposed oppositely to the photosensitive drum 11*a* with respect to the longitudinal direction in order to remove the electric charges on the photosensitive drum 11*a* after the transfer step.

Figure 9:
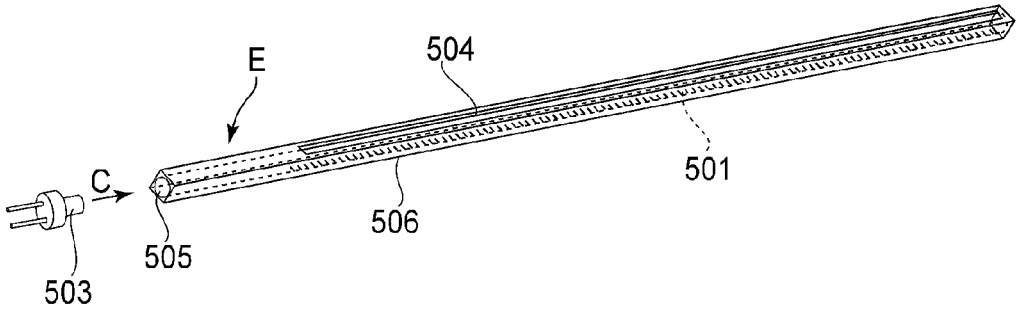
FIG. 9 is a schematic view of the light guide used in the pre-exposure means as seen in an E direction indicated in FIG. 7.

Next, with reference to FIG. 9, the light guide 501 shown in FIGS. 7 and 8 will be further described.

FIG. 9 is a schematic view of the light guide 501 shown in FIG. 7 as seen in an arrow E direction indicated in FIG. 7. As shown in FIG. 9, in actually, the light guide 501 itself is covered with a white resin case 506 as a cover for enhancing a reflection efficiency. The white resin case 506 is provided with an opening 505 as a first opening through which the light from the LED lamp 503 enters the light guide 501 and is provided with a predetermined opening 504 as a second opening opposing the photosensitive drum 11*a*. Further, this resin case 506 is mounted at a predetermined position of a process cartridge pre-exposure portion as shown in FIG. 2. That is, the light from the LED lamp as the light-emitting source provided to the image forming apparatus main assembly does not enter the end portion of the light guide 501 provided to the process cartridge until the process cartridge constituting the image forming portion is mounted in the image forming apparatus main assembly. Then, through the light guide 501 as the light irradiating member, the photosensitive drum 11*a* is irradiated with the light as the charge-removing light.

As in this embodiment, in the case where the member of a "light guide type" is used as the light irradiating member for the photosensitive drum 11*a*, compared with a "chip array type" in which a plurality of, e.g., LEDs are arranged, a ripple (degree of variation) of the light quantity on the photosensitive drum is small, so that the electric charges can be uniformly removed.

Incidentally, the LED lamp 503 in this embodiment is provided at a position opposing one end surface of the light guide 501 but may also be provided at two positions opposing both end surfaces of the light guide 501 in, e.g., the case where the light quantity is insufficient. In that case, the cuts of the light guide are made deepest (largest) at its central portion so that a light quantity distribution becomes uniform in the charge-removing area on the photosensitive drum.

As described above, by providing the optical charge-removing means 112*a* as in this embodiment, image disadvantages, such as a lateral stripe and a positive ghost, generated in a halftone image were prevented relatively inexpensively without impairing a design latitude of the image forming apparatus main assembly, so that it became possible to obtain a good image.

In this embodiment, in order to reflect the light emitted from the LED lamp 503 onto the surface of the photosensitive drum 11*a*, a reflection surface as a reflection film which is a reflection means is provided on the light guide surface by using paint (or resin) of a color (white, silver or the like) which is high in reflectance.

In this embodiment, the example in which the light guide 501 is provided to the process cartridge is described but the present invention is not limited to such an example. That is, the constitution of the process cartridge may also be such that the light guide 501 is not provided but may be provided to the image forming apparatus main assembly side. As a result, it is possible to reduce a cost of the process cartridge.

Next, the photosensitive drum 11*a* used in this embodiment will be described. Other photosensitive drums 11*b* to 11*d* also have the same constitution.

Figure 3:
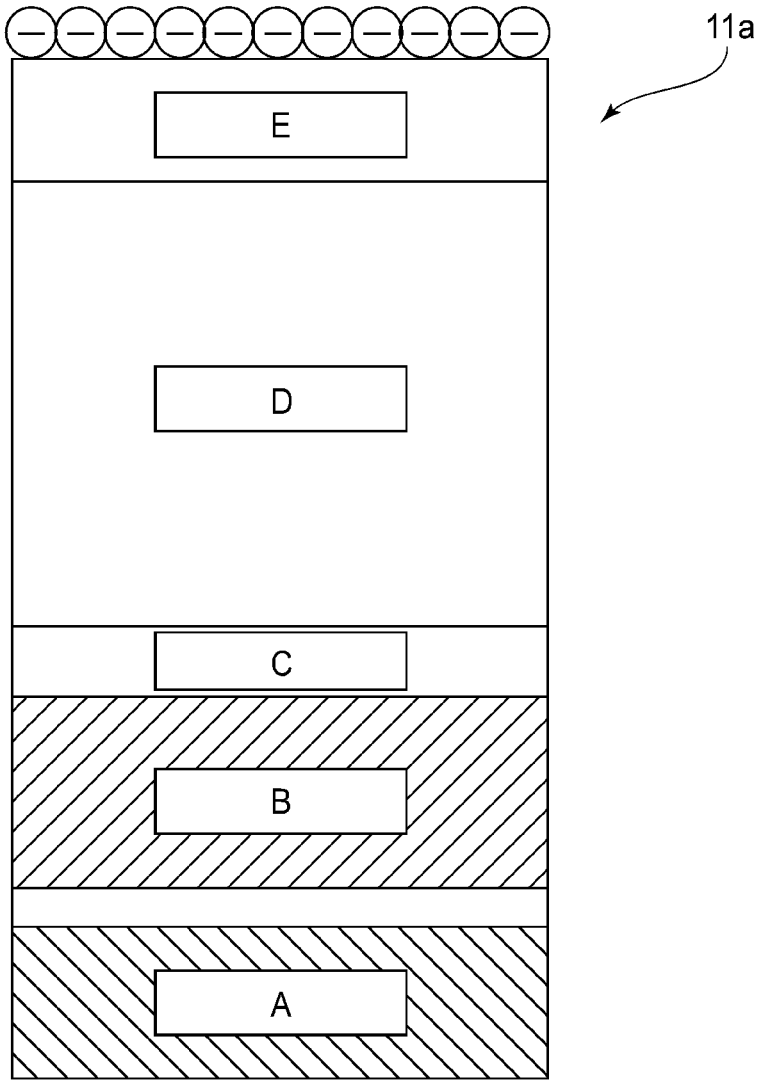
FIG. 3 is a schematic view showing a layer structure of an electrophotographic photosensitive member.

As shown in FIG. 3, the photosensitive drum 11 is an organic photosensitive member constituted by laminating on a support A an undercoat layer B, a charge generating layer C, a charge transporting layer D, and a surface layer E in this order. The support A of the electrophotographic photosensitive member is not particularly limited so long as it exhibits electroconductivity and does not adversely affect measurement of hardness. For example, as the support A, it is possible to use a drum-like molded product of metal or alloy such as aluminum, copper, chromiun, nickel, zinc, or stainless steel.

The undercoat layer B is formed for improving an adhesive property of the photosensitive layer, improving a coating property of the photosensitive layer, protecting the support, coating a defect on the support, improving a charge injection property from the support, or protecting the photosensitive layer from electrical breakdown.

On the undercoat layer B, the photosensitive layer is formed. As in this embodiment, in the case where the photosensitive member is of a functionally-separated type in which the charge (carrier) generating layer C and the charge (carrier) transporting layer D are function-separated and laminated, the charge generating layer C and the charge transporting layer D are laminated on the undercoat layer B in this order. The constitution of such a photosensitive member is well known by a person skilled in the art and therefore further detailed description will be omitted.

(Image Flow Phenomenon (Problem) to be Solved by the Present Invention)

Here, generating factors of the image flow and image blur will be described.

The surface layer (i.e., the protective layer) E of the photosensitive drum in FIG. 3 generally has a very high hardness compared with the charge transporting layer D to be less liable to be abraded in order to prevent exposure of the charge transporting layer D to the surface layer by being abraded by friction of the photosensitive member with the cleaning blade 16 or the like. The protective layer E does not influence the image formation even when there is no protective layer E, but when the charge transporting layer D is present as the surface layer, the material for the charge transporting layer D cannot be so increased in hardness in view of a characteristic thereof. For that reason, the surface layer is liable to be abraded and thus is damaged, so that the damage reaches the charge transporting layer D soon, thus causing the image defect such as a white stripe image or a halftone image non-uniformity. Further, when the hardness of the protective layer E is soft, the resultant protective layer E is meaningless. That is, when the protective layer E is abraded to expose the charge transporting layer D to the surface layer, as described above, the exposed portion of the charge transporting layer D to the surface layer is deeply damaged in many cases by the friction with the cleaning blade. For that reason, the damaged portion includes potential non-uniformity of the photosensitive drum, so that the image results in the white stripe image or causes the halftone image non-uniformity.

However, the generation of the abrasion or the damage of the photosensitive drum can be prevented but on the other hand, in the case where the electric discharge product such as NOx or ozone is deposited on the photosensitive drum surface, the electric discharge product cannot be satisfactorily removed by the cleaning blade 16. For that reason, there is the disadvantage such that the image defect such as the image flow of the image blur is liable to be caused. That is, of the electric discharge product, NOx reacts with the moisture in the air to generate nitric acid and also reacts with metal to generate metal nitrate. When the thus-generated nitric acid or metal nitrate is formed in a thin film on the image bearing member surface, by a moisture-absorbing action of these nitric acid and metal nitrate, a resistance value of the image bearing member surface is lowered. As a result, the electrostatic latent image formed on the photosensitive drum which is the image bearing member is broken and therefore particularly in a high-humidity environment, an abnormal image such that the image flows is generated.

As described above, by modification of the electric discharge product, the generated nitric acid or metal nitrate is formed in the thin layer on the photosensitive member surface and therefore it is very difficult to remove only the thin film deposited on the surface layer E of the photosensitive drum 11 by the friction with the cleaning blade 16. In order to remove only the thin film by the friction with the cleaning blade 16, there is a need to abrade off the entire surface layer of the photosensitive drum. Accordingly, hardening of the protective layer E and the suppression of the image flow by the abrasion (friction) with the cleaning blade 16 provide a trade-off relationship.

Therefore, in this embodiment, the image flow is suppressed by a method other than the method in which the phenomenon of the image flow or the image blur is suppressed by the cleaning blade 16.

Figure 4:
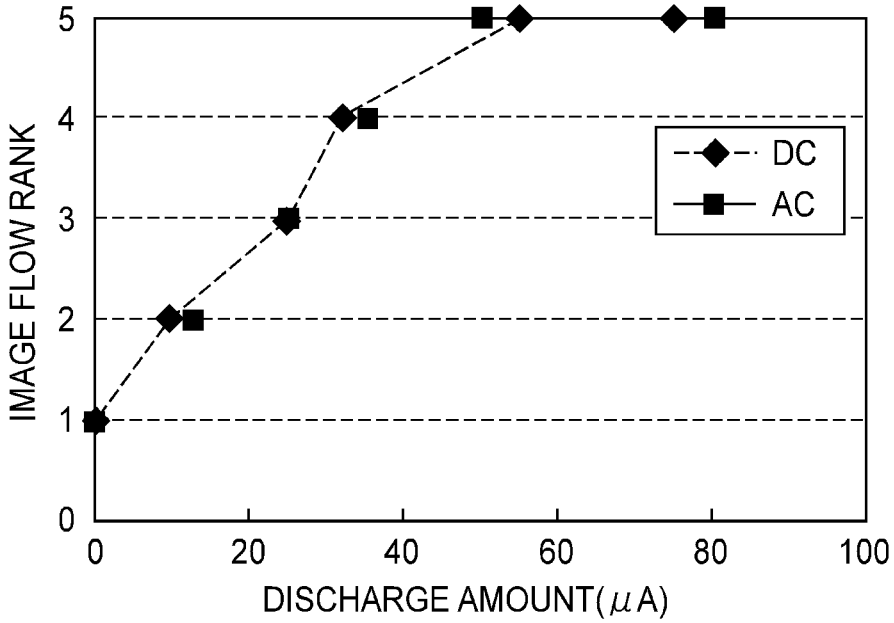
FIG. 4 is graph showing a relationship between an electric discharge amount of a charging component and an image flow occurrence level.

Here, a relationship between the generation of the electric discharge product and a charging factor will be described. FIG. 4 is a graph showing a relationship between an image flow occurrence level (represented by 5 ranks) and a discharge amount of each of a DC component and an AC component. The ranks which represent the image flow occurrence level are as follows.

Rank 1: level at which the occurrence of the image flow is not observed.

Rank 2: level at which density non-uniformity on a halftone image is generated in a drum period.

Rank 3: level at which a thin line disappears on a lattice image.

Rank 4: level at which a character is extended.

Rank 5: level at which a character is not printed at all.

The charging type is roughly classified into two types depending on a biasing method. That is, there are so-called a DC charging type in which a DC bias is applied to the contact type charging member and so-called an AC charging type in which the DC bias is superposed with an AC bias.

As shown in the graph of FIG. 4, with respect to the amount of the electric discharge product or the like which is generated during the charging and is deposited on the photosensitive drum surface as an electric discharge component by the charging member 12, if the DC component and the AC component provide the same discharge amount, it is known that the resultant deposition amounts are substantially the same. Therefore, the influences of the DC component and the AC component on the image flow are also substantially the same.

Figure 5:
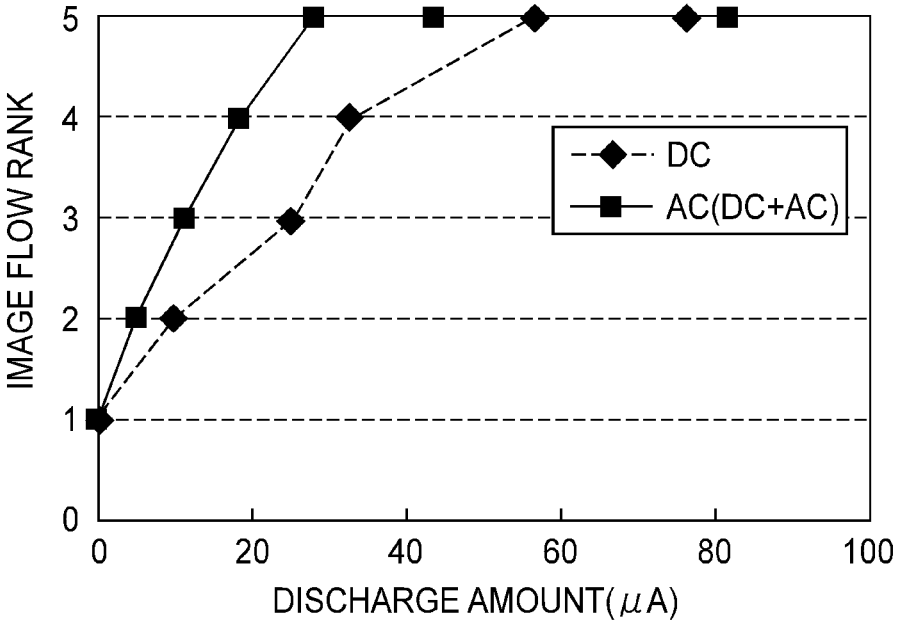
FIG. 5 is a graph showing a relationship between the electric discharge amount and the image flow occurrence level.

That is, the image flow occurrence level by the charging DC component and that by the charging AC component are substantially equivalent to each other. For that reason, in the case of the AC charging, in which the DC component is biased with the AC component, which is the charging type inconformity with a high image quality used in this embodiment, deposition of the electric discharge product in an amount which is about two times that in the case of the DC charging is promoted. Therefore, the result such that the image flow occurrence level is correspondingly worsen is obtained (FIG. 5). Thus, with respect to the image flow phenomenon, it is understood that the AC charging is disadvantageous.

Next, a block circuit of a charging bias application system in this embodiment will be described.

Figure 6:
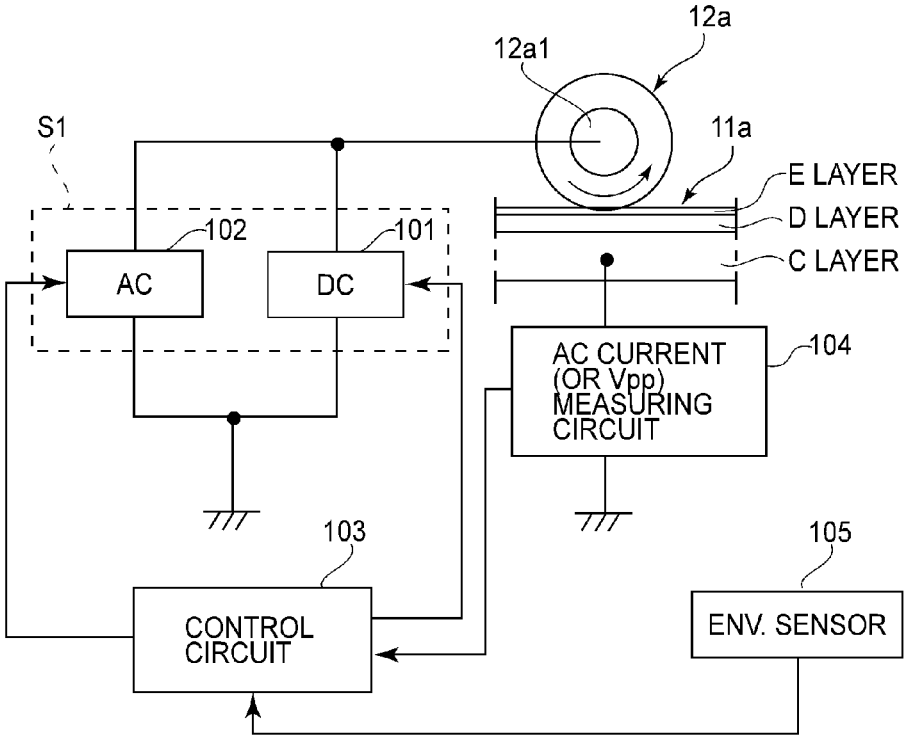
FIG. 6 is a block diagram showing an application path of a charging high voltage.

As a representative example, when the station Pa is described, FIG. 6 is a block circuit diagram of a charging bias application system with respect to the charge roller 12 used in this embodiment. A predetermined oscillating voltage in the form of a DC voltage biased (superposed) with an AC voltage having a frequency f (bias voltage: Vdc+Vac) is applied from a power source S1 to the charge roller 12*a* via the core metal 12*a*1, so that the peripheral surface of the rotating photosensitive drum 1 is charge-processed to a predetermined potential. The power source S1 as a voltage applying means for the charge roller 12 includes a DC power source (DC voltage applying means) 101 and an AC power source (AC voltage applying means) 102.

A control circuit 103 has a function of controlling the power source S1 so that either one or both (the superposition voltage) of the DC voltage and the AC voltage and applied to the charge roller 12*a* by turning the DC power source 101 or/and the AC power source 102 of the charging bias source S1 on or off. Further, the control circuit 103 also has a function of controlling the DC voltage value applied from the DC power source 101 to the charging roller 12*a* and the peak-to-peak voltage value of the AC voltage applied from the AC power source 102 to the charge roller 12*a*. An AC current value measurement circuit 104 as a means for measuring a value of AC current passing through the charging roller 12*a* via the photosensitive member 11*a* is disposed. From this circuit 104, AC current value information measured by the control circuit 103 is inputted. An environment sensor 105 as an environment detection means for detecting an environment in which the image forming apparatus 100 is provided. To the control circuit 103, detected environmental information is inputted from the environment sensor 105.

Further, from the AC current value information inputted from the AC current value measurement circuit 104 and the environmental information inputted from the environment sensor 105, the control circuit 103 has a function of executing a program for operating and determining an appropriate peak-to-peak voltage value of the AC voltage to be applied to the charging roller 12 in the charging step of the printing step.

Here, the development initializing operation in this embodiment will be described. The development initializing operation is carried out when the developing device in an uncoated state is mounted in the image forming apparatus main assembly and a period therefor is longer than a period of a normal pre-multi-rotation step.

Figure 10:
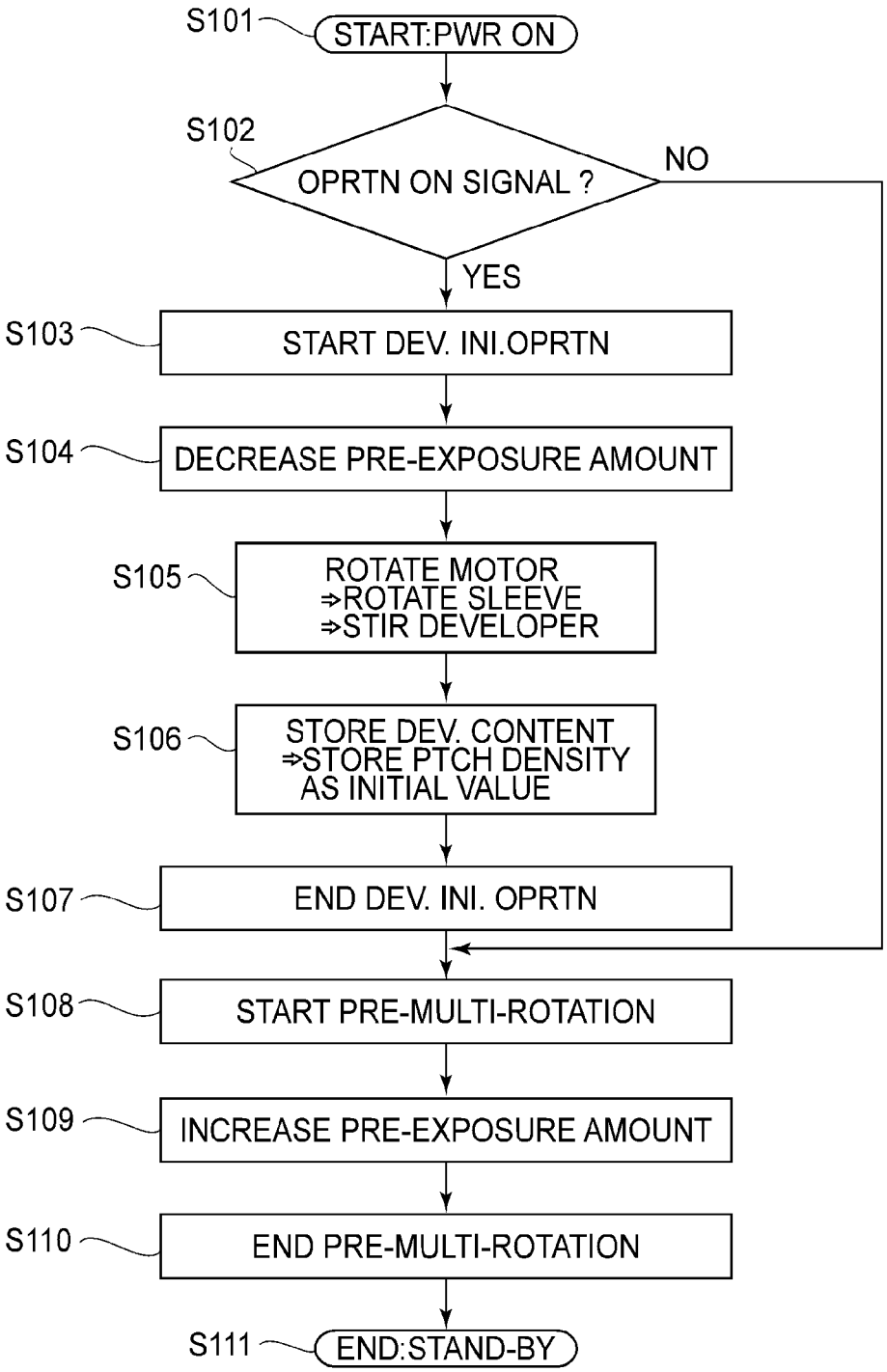
FIG. 10 is a flow chart showing a control flow of a development initializing operation in Embodiment 1.
Figure 11:
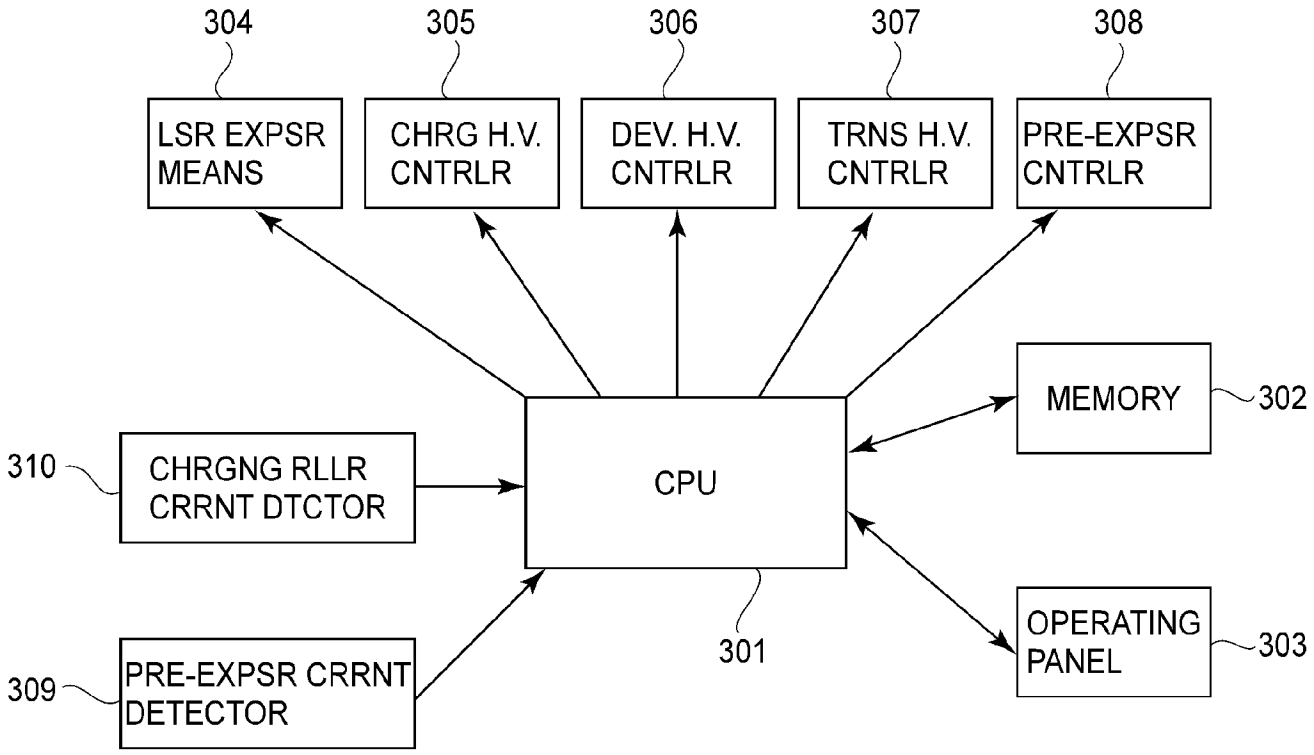
FIG. 11 is a block diagram showing execution means in the control flow.
Figure 12:
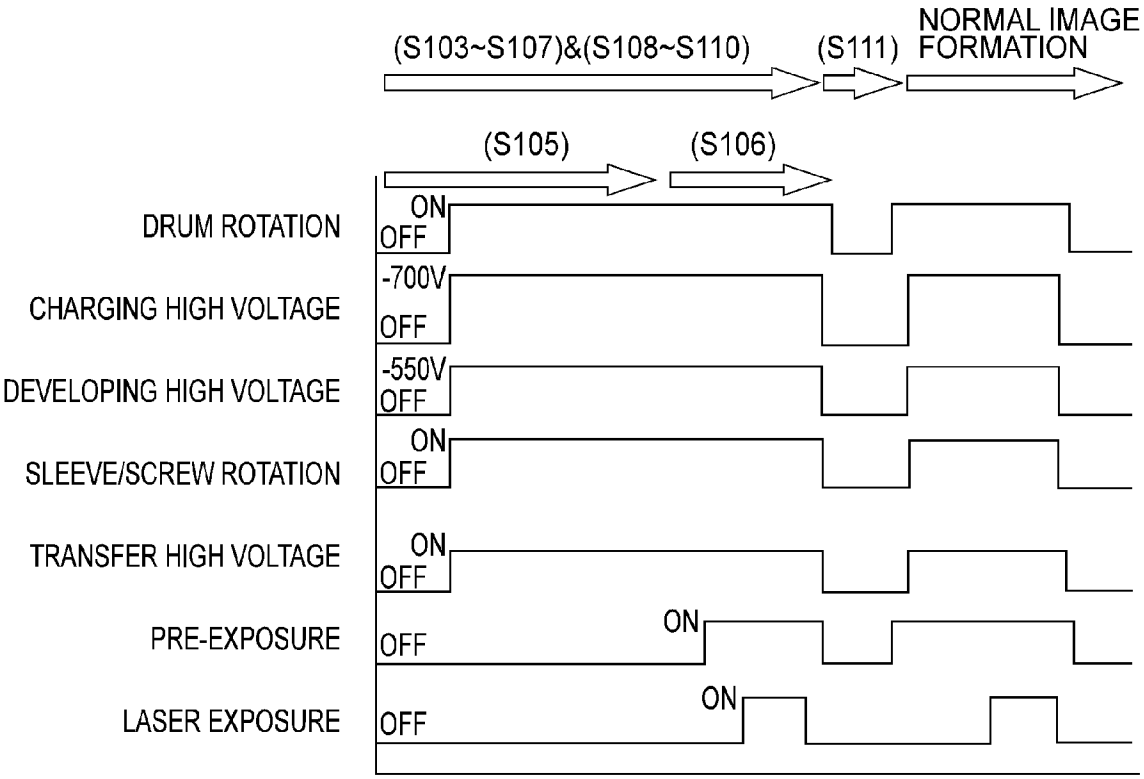
FIG. 12 is a timing chart showing operations during the development initializing operation in Embodiment 1.

The development initializing operation in this embodiment is performed along a flow shown in FIG. 10. FIG. 10 is a flow chart for illustrating a control procedure from turning-on of the power source to a stand-by state. FIG. 11 is a blocked diagram showing execution means in the control flow, and FIG. 12 is a timing chart showing operations during the development initializing operation in this embodiment.

As shown in FIG. 10, when the main power source of the main assembly is turned on (S101), the CPU 301 as the control means judges whether or not a development initializing operation instruction is provided from a user through an operating panel 303 before the main power source is turned off in a previous development initializing operation (S102). If in the case where ON signal of the development initializing operation is provided, the control means 301 performs the development initializing operation before the pre-multi-rotation operation normally performed during the turning-on of the main power source of the main assembly is started (S103).

Here, the pre-multi-rotation operation (S108) normally performed during the turning-on of the main power source of the main assembly is an initial preparatory operation performed in the main assembly until image formation. In general, on the photosensitive drum or the intermediary transfer belt, a patch image is formed with the developer. Then, a density of the patch image is read by a sensor (density sensor 77 shown in FIG. 1 in this embodiment) and whether or not the read density is proper is judged and controlled (so-called patch density control) or temperature control for controlling a temperature of the fixing member is effected. Depending on a constitution of the main assembly, the value of the DC current flowing from the charging roller 12 into the main assembly is measured by a charging roller current detecting means 310 and then drum film thickness control for judging the film thickness of the photosensitive drum is effected in some cases.

If in the case where the ON signal of the development initializing operation is not provided from the operating panel 303 to the CPU 301, after the main power source is turned on, the control means 301 determines transfer to the above-described normal pre-multi-rotation operation (S108).

Next, the development initializing operation (S103) will be described.

The development initializing operation is an operation normally performed in the case where the developing device is replaced with a new (fresh) developing device when it reaches the end of its lifetime in the main assembly or a trouble is caused, i.e., immediately before the developing device exchange. When the development initializing operation is started (S103), the control means 301 controls a pre-exposure amount of the optical charge-removing means 112 so as to be lower than that during the image formation (S104).

In this embodiment, during the development initializing operation, the CPU 301 of the main assembly performs an operation in which the developing sleeve is coated with the developer to create an image formable state (S105) to judge whether or not the developer is in an initial state. Then, the patch image for density measurement is formed on the intermediary transfer belt so that the density thereof is measurable by the patch density sensor. By measuring the patch image density, whether or not a ratio between the toner and the carrier in the developer (so-called T/D ratio) or a condition of a latent image contrast of the photosensitive drum is required to be changed is judged. In the case where the CPU 301 judges that the change is necessary, correction is made so as to change the T/D ratio from that in the initial state and in addition a condition of charging high voltage setting and developing high voltage setting is changed so as to change the latent image contrast condition. Then, the developer initial state is stored in a memory 302 of the CPU 301.

The operation for coating the developing sleeve with the developer in S105 will be further described.

The developing device is a consumable and is required to be changed to a new developing device some times until the main assembly reaches the end of its lifetime. In general, when the amount of the developer in the developing device is fluctuated or non-uniformity of coating of the developer with respect to a thrust direction is caused by abrasion of the developing sleeve surface, the developing device reaches the end of its lifetime. Then, replacement of each developing device unit or only the developer is made by a service person on a user's premises in many cases. At that time, the developing device unit which is a replacement part is normally sealed so as be suitable for transportation by the service person, i.e., so as to be sealed to prevent drop out of the developing device. Therefore, the service person releases the sealing of the developing device unit on the user's premises and mounts the developing device in the main assembly. However, in this case, the developing sleeve is in a state in which it is substantially not coated with the developer. Therefore, when the developing device is newly mounted, it is required that the developing sleeve and the developing screws in the developing device are driven and rotated for at least several minutes. Further, the developer is not required to be simply present over the inside of the developing device but is required to be triboelectrically charged to some extent so as to be moved onto the latent image portion on the photosensitive drum. For that reason, as described above, a stirring step for several minutes in the developing device is required.

Then, when the above-described development initializing operation is ended (S107), thereafter the control means 301 starts the normal pre-multi-rotation operation (S108). At this time, the control means 301 controls the pre-exposure amount outputted from the optical charge-removing means 112 so that the pre-exposure amount is larger than that during the development initializing operation (S109). Then, after the normal pre-multi-rotation operation is ended (S110), the main assembly is kept in the stand-by state and is controlled so as to await in a copy state enable state (S111).

Here, in the development initializing operation (S103), the CPU 301 as the control means judges whether or not the operation instruction is provided from the user through the operating panel 303 but there is the case where the operation is delayed when the operation is performed after the main power source turning on which is timing when the development initializing operation should be performed. That is, there is the case where the normal pre-multi-rotation operation is performed in the main assembly in a state, before the development initializing operation is performed, in which the developing sleeve is not coated with the developer. In this state, as described above, the operation in which the patch image is formed on the intermediary transfer belt with the developer and its density is read by the density sensor and then is judged and controlled as to whether or not the read image density is proper (so-called patch density control) or the like is performed. For that reason, an inconvenience such that the control cannot be effected at a proper density is caused. Therefore, in the main assembly, the control means 301 is required to perform the development initializing operation before the normal pre-multi-rotation operation is started. In order to realize this operation, in general, in a state of the immediately preceding turning-on of the main power source for performing the development initializing operation, the development initializing operation signal is required to be turned on through the operating panel 303.

FIG. 12 is a timing chart showing control timing during the development initializing operation and during subsequent image formation. Next, with reference to FIGS. 12, 10 and 11, the control of the image forming apparatus in this embodiment will be described more specifically.

As shown in FIG. 12, when the development initializing operation is started (S103), the photosensitive drum is rotated and then rotations of the developing sleeve and the developing screws are also started. At this time, commands for applying high voltages under high-voltage conditions identical to those required during the normal image formation with respect to a charging high voltage control means 305, a developing high voltage control means 306 and a transfer high voltage control means 307 are provided, so that high-voltage application is started from each of the charging high voltage control means 305, the developing high voltage control means 306 and the transfer high voltage control means 307. However, in this case, a command for turning the pre-exposure on is not provided from the CPU 301 to a pre-exposure amount control means 308 or the pre-exposure amount is set at a value lower than that during normal image setting (S104). That is, operations including an idling operation of the developing device, the coating of the developing sleeve with the developer and developer stirring (S105) are performed for several minutes with setting of the charging high voltage: ON, the developing high voltage: ON, the transfer high voltage: ON, and the pre-exposure: OFF or the pre-exposure amount: small. In this embodiment, the setting includes the pre-exposure: OFF.

Generally, the idling time may appropriately be 2 to 3 minutes in view of a coating time of the developing sleeve with the developer and a charging time of the developer but in this embodiment the idling time (S105) was 2 minutes. A conventional operation was performed with setting of the pre-exposure: ON with respect to the pre-exposure amount control means 308 during the operations including the idling operation of the developing device, the developer coating onto the developing sleeve and the developer stirring. However, by study of the present inventor, it was found that the image flow is generated on the photosensitive drum when the time of applying the charging high voltage and performing the idling of the photosensitive drum in a state in which the developer is not coated on the developing sleeve. That is, during this time, the developer is in a state in which the amount of the developer transferred onto the photosensitive drum (so-called developer fog) is very small. For that reason, the developer is not sufficiently supplied to the cleaning blade and thus the electric discharge product on the photosensitive drum cannot be satisfactorily removed by the cleaning blade edge portion, so that the image flow is liable to occur.

However, also in this case, the amount of the electric discharge product deposited on the photosensitive drum, i.e., an amount of electric discharge current passing from the charging member to the photosensitive drum is minimized, so that it was substantiated that the occurrence of the image flow can be suppressed.

Then, as shown in FIG. 12, the operation goes to an operation for storing the developer initial state in the memory 302 of the CPU 301 (S106). As described above, this operation is an important operation for confirming the density of the developer in the initial state to determine a future course of action of the control of the developer and therefore a condition for the operation is required to be brought near to the normal image forming condition as close as possible when the patch image is formed. The setting of the charging high voltage, the developing high voltage, the transfer high voltage, the pre-exposure amount and the like is commonly made so as to be equal to that under an actual image forming condition. When the light quantity of the pre-exposure is lowered with this timing, a condition of the surface potential of the photosensitive drum after passing through the charging member is somewhat changed and therefore there is a possibility that the change adversely affects the density when the patch image is formed. Therefore, in this embodiment, during the operation for storing the developer initial state in the CPU 301 (S106), the pre-exposure amount is set at the light quantity during the normal image formation. As shown in FIG. 12, during the normal image formation after the development initializing operation, the pre-exposure light quantity is quickly increased just by a predetermined amount by the pre-exposure control means 308 and a pre-exposure LED current circuit current-detecting means 309, so that the setting is returned to that during the normal image formation. As a result, consideration is given so that the pre-exposure does not have the influence on the prevention of the ghost image and the image density control which are functions of conventional pre-exposure.

That is, in this embodiment, the image flow suppression is made by only a means for decreasing the pre-exposure light quantity during only the developing device idling operation, in the development initializing operation, which does not have the influence on the image formation to the end. That is, according to the present invention, a particular device is not required during the development initializing operation, so that the occurrence of the image flow can be suppressed by a method which does not adversely affect the image formation at all.

Figure 13:
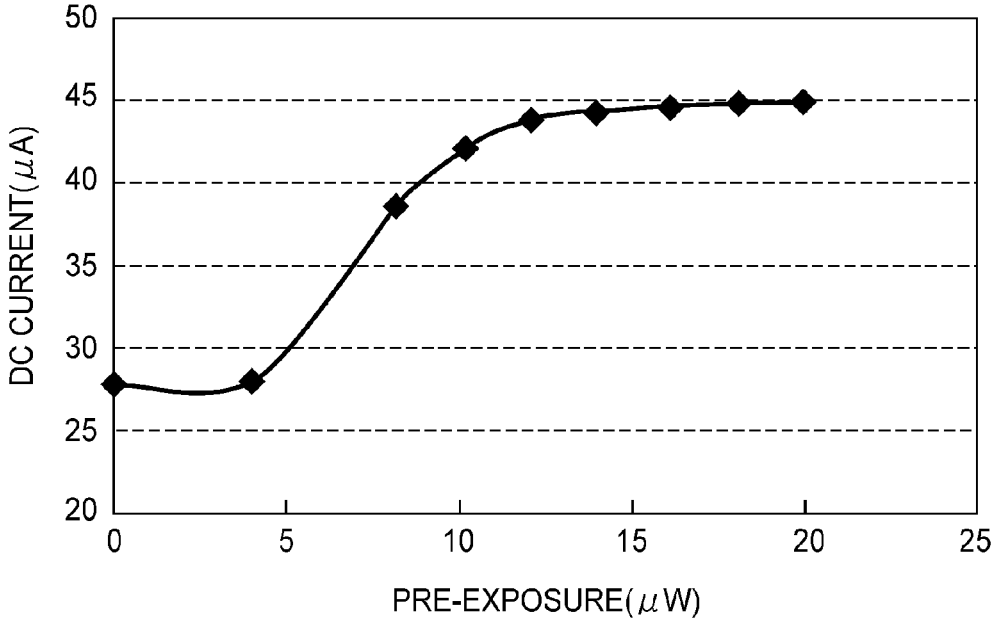
FIG. 13 is a graph showing a relationship between a pre-exposure light quantity and a charging DC current component in Embodiment 1.

FIG. 13 shows a relationship between the pre-exposure light quantity and the discharge amount of the charging DC component. As is understood from FIG. 13, the amount of the current passing from the charging member 12 to the photosensitive drum tends to increase with an increase of the pre-exposure light quantity and tends to decrease with a decrease of the pre-exposure light quantity. This is because depending on whether or not the electric charges of the photosensitive drum are removed by the light of the pre-exposure, the potential of the drum surface when the photosensitive drum surface having passed through the neighborhood of the pre-exposure member passes through the charging member again is changed. That is, the photosensitive drum surface from which the electric charges are removed by the pre-exposure is charge-removed at a potential lower than the potential of the drum surface after passing through the transfer member. Specifically, the drum surface normally changed to −700 V is changed to about −300 V after passing through the transfer member but when this drum surface is charge-removed by the pre-exposure means (optical charge-removing means 112), the potential is changed to about −50 to −100 V. In this case, when the charge-removed drum surface passes again through the charging member to which the high voltage of −700 V is applied, a current of the DC component corresponding to a contrast of 600 V to 650 V which is a difference between −700 V and −50 V to −100 V (i.e., charging DC current) flows, so that a resultant current amount reaches about 45 μA.

However, in the case where the pre-exposure amount is substantially 0 V and thus the drum surface is little charge-removed, reversely, the drum surface charged to −700 V is changed to about −300 V after passing through the transfer member. The drum surface reaches again the charging member as it is and therefore only the DC current (charging DC current) corresponding to a contrast of 400 V which is a difference between −700 V and −300 V flows, so that a resultant current amount is about 27 μA.

Therefore, during the development initializing operation which does not influence the image formation, particularly with timing when the developer is coated on the developing sleeve and with timing when the developer is stirred, the discharge amount of the DC component from the charging member is controlled so as to be decreased as small as possible. That is, by decreasing the light quantity of the pre-exposure, it became possible to suppress the occurrence of the image flow during the mounting of the developing device.

A relationship between a setting condition of the pre-exposure light quantity during the development initializing operation and a rank of the image flow is shown in Table 1.

TABLE 1

| | SANIF*3 | | LTNIF*4 | | | |
|---|---|---|---|---|---|---|
| PELQ*1 (μW) | 20 | 15 | 10 | 5 | 3 | 0 |
| IFOL*2 | 5 | 5 | 4 | 4 | 2 | 1 |

*1"PELQ" represents the pre-exposure light quantity (μW).
*2"IFOL" represents the image form occurrence level.
*3"SANIF" represents that the setting condition is the same as that during the normal image formation.
*4"LTNIF" represents that the setting condition is lower than that during the normal image formation.

According to the study by the present inventor, the occurrence of the image flow, during the development initializing operation, which is the problem to be solved was able to be suppressed only by changing the setting of the pre-exposure light quantity only with the timing when the image formation is not influenced. Further, as described above, according to the present invention, it is possible to suppress the occurrence of the image flow by an inexpensive and space-saving method which does not require the particular device during the development initializing operation and does not have the influence at all during the image formation.

Embodiment 2

Next, Embodiment 2 of the present invention will be described. An image flow suppressing method in this embodiment will be described with reference to a flow chart of FIG. 14, a timing chart of FIG. 15, and a relationship between charging DC high voltage setting and charging DC current amount of FIG. 16. In this embodiment, an image forming apparatus is just the same as that in Embodiment 1, and all settings other than setting described below are the same as those for the image forming apparatus in Embodiment 1. Therefore, the image forming apparatus in this embodiment will be omitted from redundant description.

The control procedure from the turning on of the main power source to the stand-by state is the same as that shown in the flow chart of FIG. 10 in Embodiment 1 except for steps S204 and S209 which are different from the steps S104 and S109, respectively, in Embodiment 1. That is, in Embodiment 1, the pre-exposure light quantity is controlled in S104 and S109, but in this embodiment, the charging high voltage is controlled in S204 and S209. Therefore, the difference from Embodiment 1 will be principally described with reference to FIGS. 14 and 15 in combination with FIG. 11.

Figure 14:
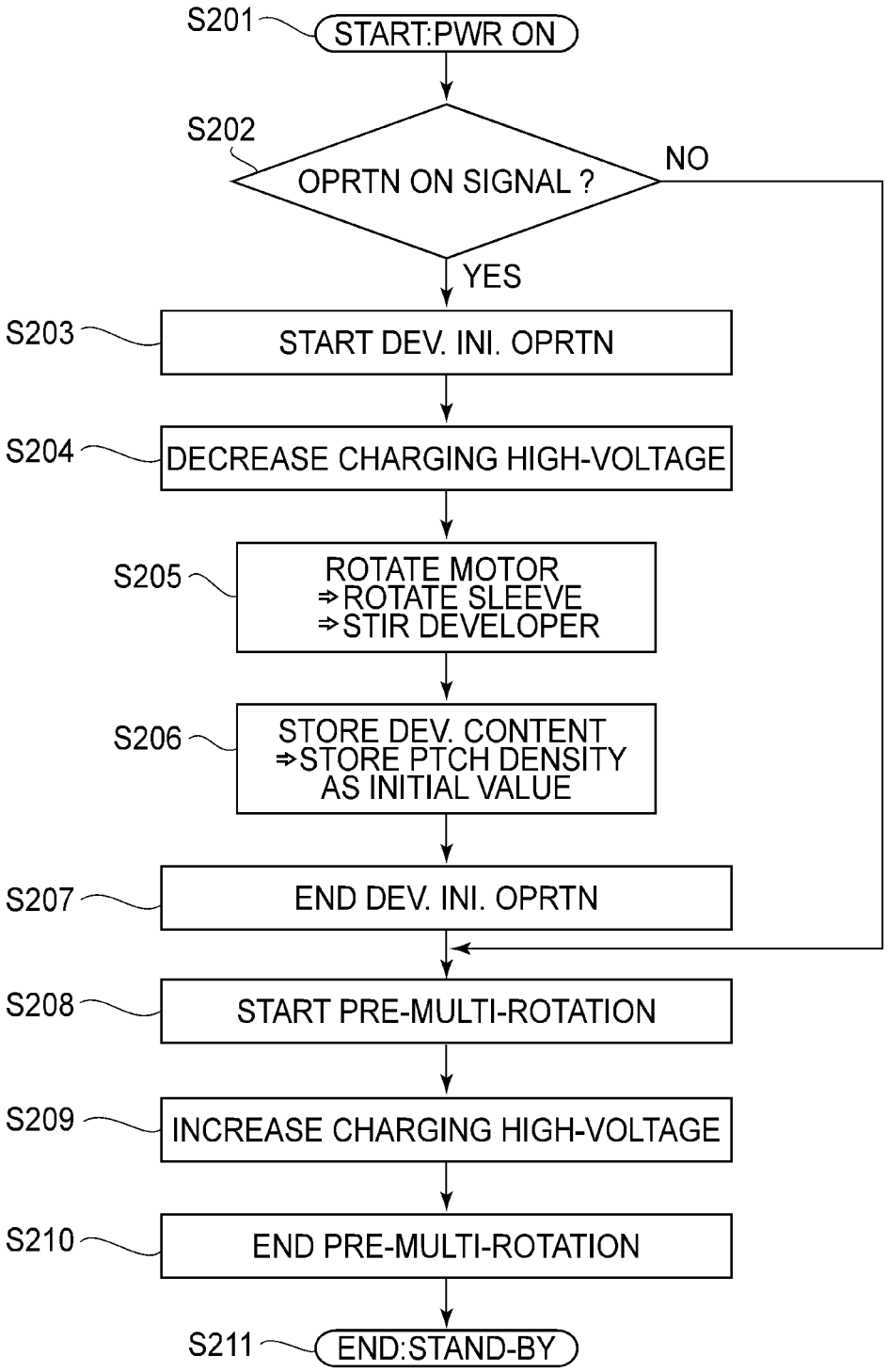
FIG. 14 is a flow chart showing a control flow of a development initializing operation in Embodiment 2.
Figure 15:
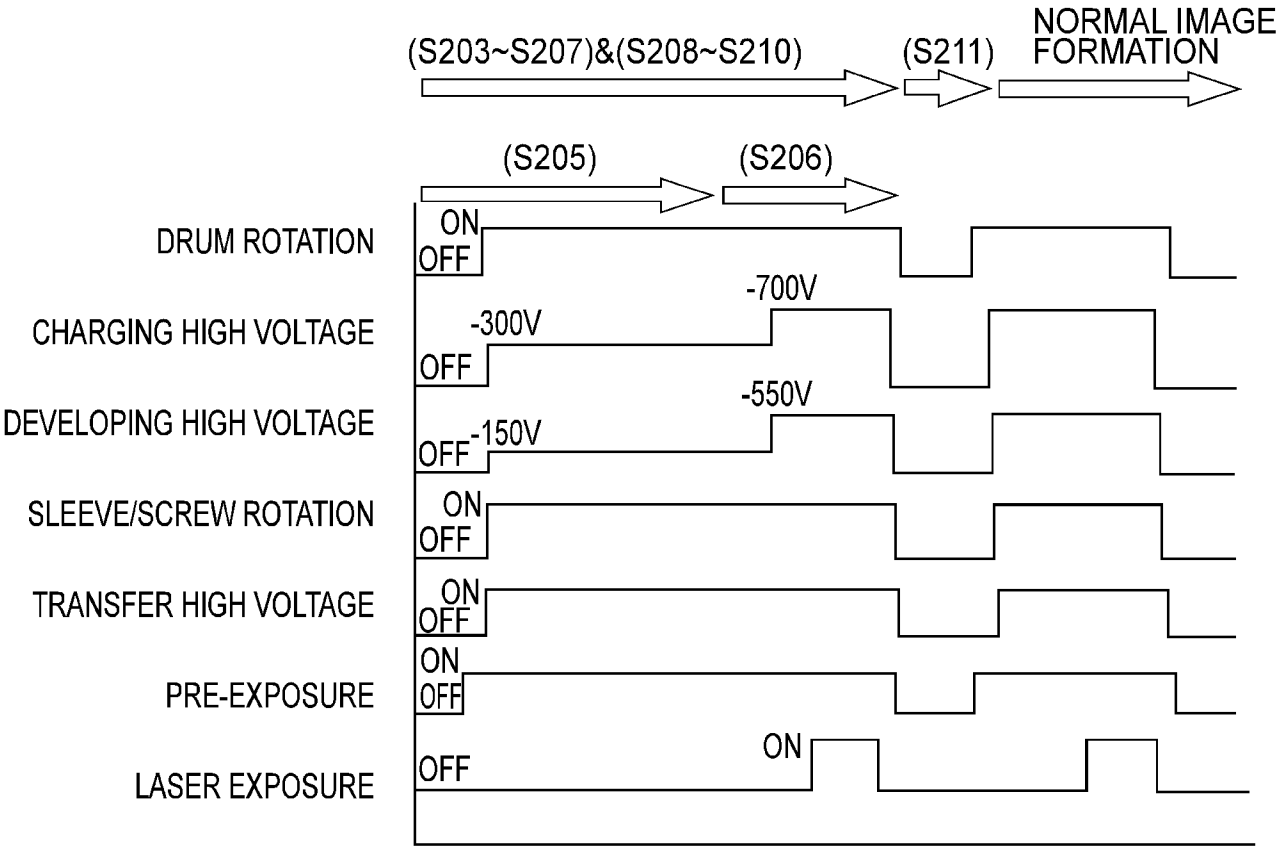
FIG. 15 is a timing chart showing operations during the development initializing operation in Embodiment 2.

As shown in FIGS. 14 and 15, when the development initializing operation is started (S203), the photosensitive drum is rotated and then rotations of the developing sleeve and the developing screws are also started (S205). At this time, a command for applying a high voltage under a high-voltage condition identical to that required during the normal image formation with respect to the transfer high voltage control means 307 is provided, so that high-voltage application is started from and the transfer high voltage control means 307. Further, also to the pre-exposure amount control means 308, a command for irradiating the drum surface by the pre-exposure in a light quantity equal to that during the normal image formation is provided, so that the light is emitted from the pre-exposure control means 308. The pre-exposure light quantity is detected by the pre-exposure LRD current circuit current-detecting means 309. However, in this case, commands with setting different from that during the normal image formation are provided from the CPU 301 to the charging high voltage control means 305 and the developing high voltage control means 306 (S204). That is, operations including an idling operation of the developing device, the coating of the developing sleeve with the developer and developer stirring (S205) are performed for several minutes in a state of the transfer high voltage: ON and the pre-exposure: ON.

Generally, the idling time may appropriately be 2 to 3 minutes in view of a coating time of the developing sleeve with the developer and a charging time of the developer but in this embodiment the idling time (S205) was 2 minutes. Further, as shown in FIG. 15, as the setting of the charging high voltage and the developing high voltage which are set at values lower than those during the normal image formation, the charging high voltage during the normal image formation was −700 V, whereas the charging high voltage during the developing device idling was set at −300 V. Further, the developing high voltage during the normal image formation was −550 V, whereas the developing high voltage during the developing device idling was set at −150 V.

A conventional operation was performed with the same setting as the normal image setting with respect to the charging high voltage and the developing high voltage during the operations including the idling operation of the developing device, the developer coating onto the developing sleeve and the developer stirring. However, by study of the present inventor, it was found that the image flow is generated on the photosensitive drum when the time of applying the charging high voltage and performing the idling of the photosensitive drum in a state in which the developer is not coated on the developing sleeve. That is, during this time, the developer is in a state in which the amount of the developer transferred onto the photosensitive drum (so-called developer fog) is very small. For that reason, the developer is not sufficiently supplied to the cleaning blade and thus the electric discharge product on the photosensitive drum cannot be satisfactorily removed by the cleaning blade edge portion, so that the image flow is liable to occur.

However, also in this case, the amount of the electric discharge product deposited on the photosensitive drum, i.e., an amount of electric discharge current passing from the charging member to the photosensitive drum is minimized, so that it was substantiated that the occurrence of the image flow can be suppressed.

Then, as shown in FIGS. 12, 14 and 15, similarly as in Embodiment 1, the operation goes to an operation for storing the developer initial state in the memory 302 of the CPU 301 (S206). As described above, this operation is an important operation for confirming the density of the developer in the initial state to determine a future course of action of the control of the developer. For that reason, a condition for the operation is required to be brought near to the normal image forming condition as close as possible when the patch image is formed. The setting of the charging high voltage, the developing high voltage, the transfer high voltage, the pre-exposure amount and the like is commonly made so as to be equal to that under an actual image forming condition. When the charging high voltage is lowered with this timing, a latent image contrast in the case where the latent image for a patch image is formed by the laser exposure is changed and therefore there is a possibility that the change adversely affects the density when the patch image is formed. Therefore, in this embodiment, during the operation for storing the developer initial state in the CPU 301 (S206), the pre-exposure condition is the same as that in the state during the normal image formation. Further, as shown in FIG. 15, during the normal image formation after the development initializing operation, the high voltage setting for the charging high voltage and the developing high voltage is quickly changed and then is returned to that during the normal image formation, whereby consideration is given so that the high voltage setting does not have the influence on the actual image formation.

That is, in this embodiment, the image flow suppression is made by only a means for setting the charging high voltage and the developing high voltage at low levels during only the developing device idling operation, in the development initializing operation, which does not have the influence on the image formation to the end. Therefore, also in this embodiment, it is possible to achieve a functional effect similar to that in Embodiment 1.

Figure 16:
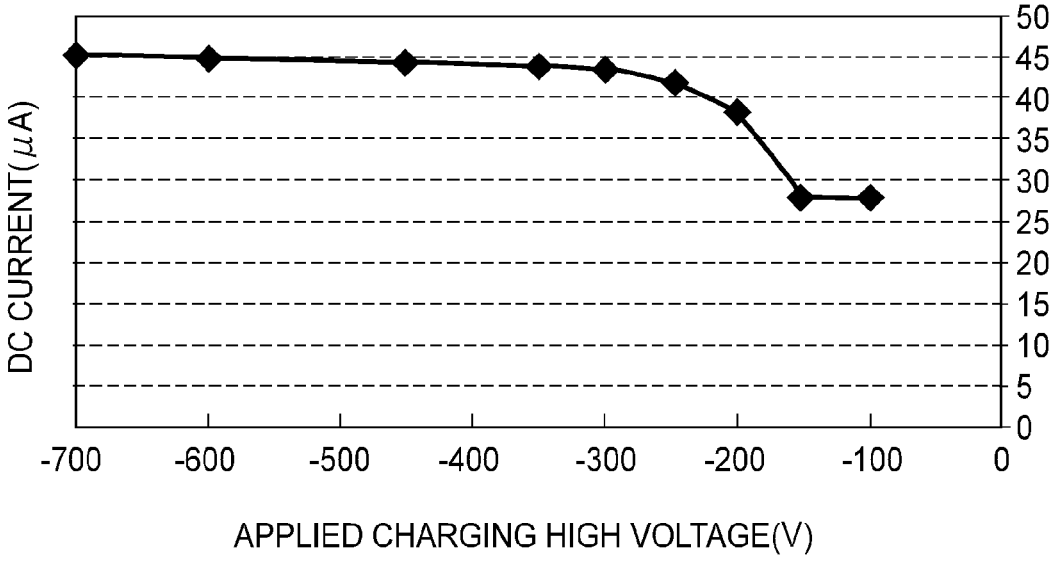
FIG. 16 is a graph showing a relationship between a charging DC high voltage and a charging DC current component in Embodiment 2.

FIG. 16 shows a relationship between the charging high voltage setting and the discharge amount of the charging DC component. As is understood from FIG. 16, the amount of the current passing from the charging member 12 to the photosensitive drum tends to increase with an increase of the charging high voltage setting (absolute value of the voltage) and tends to decrease with a decrease of the charging high voltage setting (absolute value of the voltage). This is because the potential of the drum surface when the photosensitive drum surface passes through the charging member is changed. That is, the photosensitive drum surface is, specifically the drum surface normally changed to −700 V is charge-removed by the pre-exposure after passing through the transfer member, so that the potential is changed to about −50 to −100 V. Even when the charging high voltage setting is −300 V, the drum surface potential after the drum surface passes through the pre-exposure means is about −50 to −100 V. With respect to the developing high voltage, it is known that when a potential difference between itself and the charging high voltage (so-called Vback potential) is not controlled at a constant level, adverse effects such as carrier deposition when the Vback potential is excessively large, and fog when the Vback potential is excessively small are caused to occur. For that reason, when the charging high voltage is lowered, there is a need to lower the developing high voltage by offset together with the charging high voltage. Here, in this case, with respect to the high voltage setting is −700 V, when the above-described normal drum surface passes again through the charging member to which the high voltage of −700 V is applied, a current of the DC component in an amount corresponding to a contrast of 600 V to 650 V which is a difference between −700 V and −50 V to −100 V flows, so that a resultant current amount reaches about 45 μA.

However, in the case where charging high voltage setting is −300 V, only the DC current corresponding to a contrast of 150 V to 200 V which is a difference between −300 V and −50 V to −100 V flows, so that a resultant current amount is about 30 μA.

Therefore, during the development initializing operation which does not influence the image formation, particularly with timing when the developer is coated on the developing sleeve and with timing when the developer is stirred, the discharge amount of the DC component from the charging member is controlled so as to be decreased as small as possible. That is, by decreasing the charging high voltage value (absolute value), it became possible to suppress the occurrence of the image flow during the mounting of the developing device.

A relationship between a setting condition of the charging DC high voltage during the development initializing operation and a rank of the image flow is shown in Table 2.

TABLE 2

| | SANIF*3 | | | LTNIF*4 | | |
|---|---|---|---|---|---|---|
| CDCV*1 (V) | −700 | −550 | −450 | −350 | −300 | −250 |
| IFOL*2 | 5 | 5 | 5 | 5 | 2 | 2 |

*1"CDCV" represents the charging DC voltage (V).

*2"IFOL" represents the image form occurrence level.

*3"SANIF" represents that the setting condition is the same as that during the normal image formation.

*4"LTNIF" represents that the setting condition is lower than that during the normal image formation.

According to the study by the present inventor, the occurrence of the image flow, during the development initializing operation, which is the problem to be solved was able to be suppressed only by changing the setting of the charging high voltage only with the timing when the image formation is not influenced.

In the above-described embodiments, the present invention is described as the color image forming apparatus of the intermediary transfer type but is not limited thereto.

The present invention is also applicable to, e.g., a color image forming apparatus of a direct transfer type in which the toner images formed on the surfaces of the respective photosensitive drums 11 (11*a*, 11*b*, 11*c*, 11*d*) are successively and directly transferred onto the recording material which is a transfer-receiving material conveyed to the respective stations P (Pa, Pb, Pc, Pd) by the recording material carrying member. A constitution of such an image forming apparatus is well known by the person skilled in the art and therefore will be omitted from further detailed description.

To such a color image forming apparatus of the direct transfer type, it is possible to apply the constitutions of Embodiments 1 and 2 described above. In the color image forming apparatus of the direct transfer type, the same constitutions as those in Embodiments 1 and 2 are employed, so that a similar functional effect can be achieved.

Incidentally, in the above-described embodiments, the development initializing operation in the case where the developing device is replaced is described but the present invention is not limited thereto. For example, the present invention may also be adopted to the case where the developing device and another process element are assembled into a unit. That is, in an initializing step performed when a unit in a state in which the developer carrying member (developing sleeve) is not coated with the toner is mounted, the control embodiments of the present invention may also be employed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 021579/2011 filed Feb. 3, 2011, which is hereby incorporated by reference.

What is claimed is:

1. An image forming apparatus comprising:

a photosensitive member;

a charging device for electrically charging said photosensitive member at a charging portion;

an electrostatic image forming portion for forming an electrostatic image on said photosensitive member electrically charged by said charging device;

a developing device for developing the electrostatic image formed on said photosensitive member, wherein said developing device includes a carrying member for carrying and conveying a toner to a developing position, and includes a screw, which is rotated by receiving a driving force from a driving source, for feeding the toner;

a charging power source for applying a charge potential to said charging device;

a developing power source for applying a developing potential to said developing device;

a transfer device for transferring a toner image formed on said photosensitive member at a transfer portion;

an exposure device, provided downstream of the transfer portion and upstream of the charging portion with respect to a rotational direction of said photosensitive member, for electrically discharging a surface of said photosensitive member by exposing said photosensitive member to light; and a controller for effecting control so that a toner feeding operation for feeding the toner to said carrying member on which no toner is substantially carried is performed by rotating said screw without forming the electrostatic image on said photosensitive member by said electrostatic image forming portion, wherein said controller controls said charging power source and said developing power source so that a polarity of a value obtained by subtracting developing potential from a surface potential of said photosensitive member electrically charged by said charging device is an identical polarity to a charge polarity of the toner in a period in which the toner feeding operation is performed, and wherein said controller controls said exposure device so that an exposure operation by said exposure device is in an off state in the period in which the toner feeding operation is performed or so that an exposure amount of said exposure device in the period in which the toner feeding operation is performed is smaller than an exposure amount of said exposure device in a period in which the toner image is formed on the surface of said photosensitive member.

2. An image forming apparatus comprising:

a photosensitive member;

a charging device for electrically charging said photosensitive member at a charging portion;

an electrostatic image forming portion for forming an electrostatic image on said photosensitive member electrically charged by said charging device;

a developing device for developing the electrostatic image formed on said photosensitive member, wherein said developing device includes a carrying member for carrying and conveying a toner to a developing position, and includes a screw, which is rotated by receiving a driving force from a driving source, for feeding the toner;

a charging power source for applying a charge potential to said charging device;

a developing power source for applying a developing potential to said developing device;

a transfer device for transferring a toner image formed on said photosensitive member at a transfer portion;

an exposure device, provided downstream of the transfer portion and upstream of the charging portion with respect to a rotational direction of said photosensitive member, for electrically discharging a surface of said photosensitive member by exposing said photosensitive member to light; and a controller for effecting control so that an operation for feeding the toner to said carrying member on which no toner is substantially carried is performed by rotating said screw without forming the electrostatic image on said photosensitive member by said electrostatic image forming portion, wherein said controller controls said charging power source and said developing power source so that a polarity of a value obtained by subtracting developing potential from a surface potential of said photosensitive member electrically charged by said charging device is an identical polarity to a charge polarity of the toner in a period in which the toner feeding operation is performed, and wherein said controller controls the charge potential to be applied to said charging device so that a DC current flowing through said charging device in the period in which the toner feeding operation is performed is smaller than a DC current flowing through said charging device in a period in which the toner image is formed on the surface of said photosensitive member.

* * * * *